US006824293B2

(12) United States Patent
Chang

(10) Patent No.: US 6,824,293 B2
(45) Date of Patent: Nov. 30, 2004

(54) DECORATION LAMP HOLDER

(76) Inventor: Chih-Chen Chang, 10F-2, No. 8, Lane 179, Wuling Rd., Hsinchu City (TW)

( * ) Notice: Subject to any disclaimer, the term of this patent is extended or adjusted under 35 U.S.C. 154(b) by 0 days.

(21) Appl. No.: 10/281,437

(22) Filed: Oct. 28, 2002

(65) Prior Publication Data

US 2004/0080937 A1 Apr. 29, 2004

(51) Int. Cl.[7] ..... H01R 33/90

(52) U.S. Cl. ..... 362/226; 362/249; 313/318.01; 439/699.2

(58) Field of Search ..... 313/318.01, 318.05, 313/318.1; 439/699.2, 619, 699; 362/249, 252, 396

(56) References Cited

U.S. PATENT DOCUMENTS 5,137,465 A * 8/1992 Chwang ..... 439/356

* cited by examiner

*Primary Examiner*—John Anthony Ward
(74) *Attorney, Agent, or Firm*—Charles E. Baxley

(57) ABSTRACT

The present invention provides a decoration lamp holding frame, in which the bulb base has a bar-base portion with a stopper at the bottom side, and an ejector pin extended downward from the bottom side of said stopper, and the diameter of the bar-base portion is a bit bigger than or equal the inside diameter of the lamp holder so that the bar-base portion of the bulb base is emerged into the lamp holder fully as they are connected together, meanwhile the back end of the ejector pin stretches to the bottom opening of the lamp holder, thereby to increase the difficulty of picking-off bulb; but when the bulb runs away, pushing up the ejector pin from the bottom opening of the holder with a tool takes off the bulb base from the lamp holder facilitating to replace.

1 Claim, 4 Drawing Sheets

DECORATION LAMP HOLDER

BACKGROUND OF THE INVENTION

1. Field of the Invention

The present invention relates to a Christmas decoration lamp holder, and more particularly to a holding frame used for retaining a decorating lamp string avoiding someone maliciously pulling out a bulb from one site so as to affect all the lamps on the string.

2. Description of Prior Art

In accordance with the conventional Christmas decorating lamps, most of them are serially connected into a string, just as if one of them is broke down or off, the rest of string after that will be lost power so as to be lightless, therein the fault of the bulb is unavoidable, just need to find out the fail point to fix up, but in most of cases the bulb is broken off by some malicious action. Investigating the sake of it, we find that for facilitating to install or take apart the conventional decoration lamp takes the advantage of clamping down the bulb base on the holder as socket and spigot joint to fasten and connect the bulb to the power. The conventional decoration lamp holder is shown in FIG. 4, wherein the bulb base 2' has a flange 23' at the upper portion for locating on the tip end of the lamp holder 1' as plugging the bulb base 2' into clamping position to form a cap. When the bulb is failure to light, just need to grip the flange 23', and easily pull out the bulb base 2' from the holder 1' for replacing. Because the flange 23' is exposed outside of the holder 1', the mischievous guy can easily pull out the bulb 3' with the base 2' too, so as to make all the lamps after it lose power.

OBJECTS AND SUMMARY OF THE INVENTION

It is therefore a main object of the present invention to provide a decoration lamp holding frame, in which the bulb base is embedded into the holder in flush-bonding so as to avoid the bulb base pulling out easily by person with finger without any tool.

The another object of the present invention is to provide a decoration lamp holding frame, in which the bulb base can be easily pushed out by exerting a force from the back end of the lamp holder.

These objects are achieved by a decoration lamp holding frame, in which the bulb base has a bar-base portion extending downward an ejector pin, and the diameter of the bar-base portion is a bit bigger than or equal the inside diameter of the lamp holder so that the bar-base portion of the bulb base is emerged into the lamp holder fully as they are connected together, meanwhile the back end of the ejector pin stretches to the bottom opening of the lamp holder, thereby to increase the difficulty of picking-off bulb; but when the bulb runs away, pushing up the ejector pin from the bottom opening of the holder with a tool takes off the bulb base from the lamp holder facilitating to replace.

DETAILED DESCRIPTION OF PREFERRED EMBODIMENTS

Figure 1:
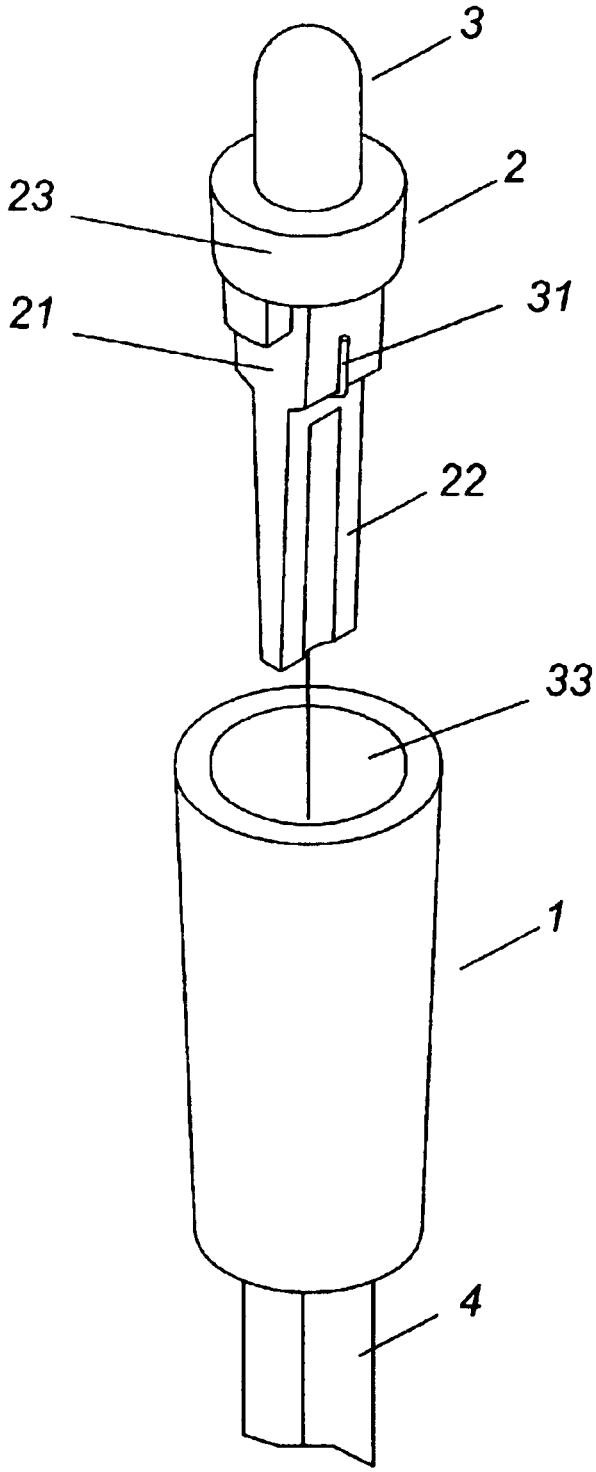
FIG. 1 is an exploded solid view of the present invention.
Figure 2:
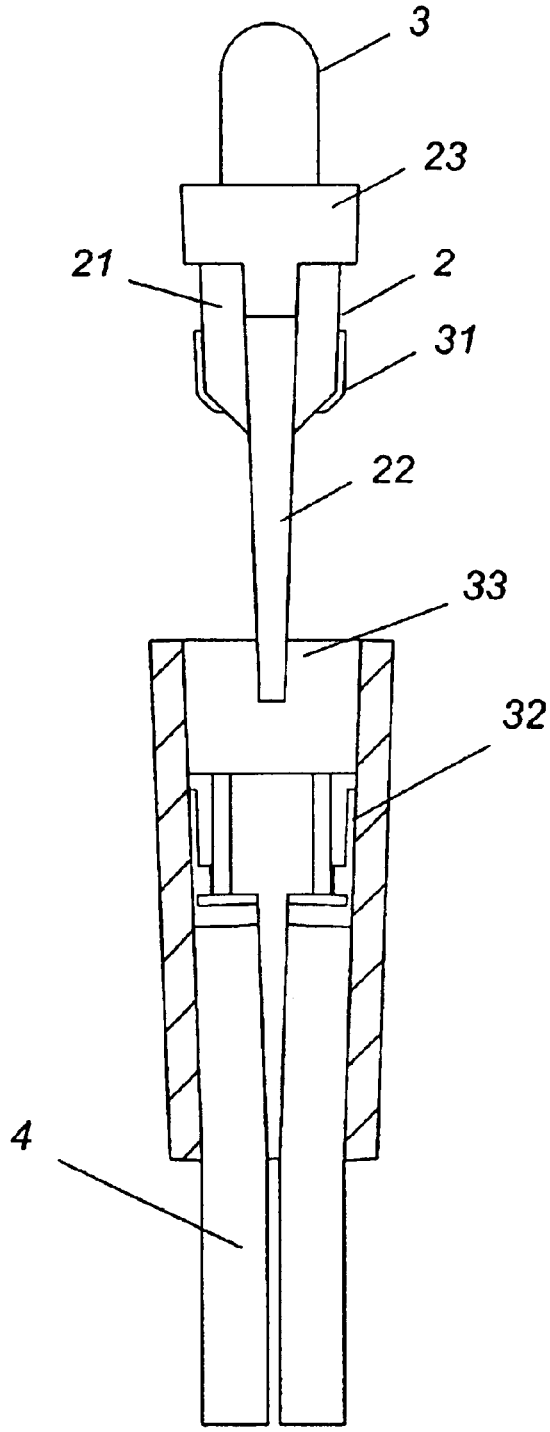
FIG. 2 is an exploded sectional view of the present invention.

Referring to FIG. 1 and FIG. 2, the bulb base 2 is consisted of a bar-base portion 23, a stopper 21 and an ejector pin 22 sequentially in a whole molded piece, which can be plugged into a lamp holder 1 for clamping connection. Wherein, the diameter of the bar-base portion 23 of said bulb base 2 is a bit bigger than or equal the inside diameter of the lamp socket 33 of the lamp holder 1, a stopper 21 formed next said bar-base portion 23 extends downward a long ejector pin 22, so that the sum height of the bar-base portion 23, the stopper 21 and the ejector pin 22 is bigger or equal the depth of the lamp socket 33 of said lamp holder 1. The lamp socket 33 of said lamp 1 has a hollow inside shaped coordinating to the every portions of said bulb base 2, therein the segment of said lamp socket 33 coordinating to the bar-base portion 21 provides a housing depth that is bigger or equal the axial length of said bar-base portion 21, in the same way, the whole bulb base 2 including the bulb 3 and the cord is embedded into said lamp socket 33 of said lamp holder 1.

Figure 3:
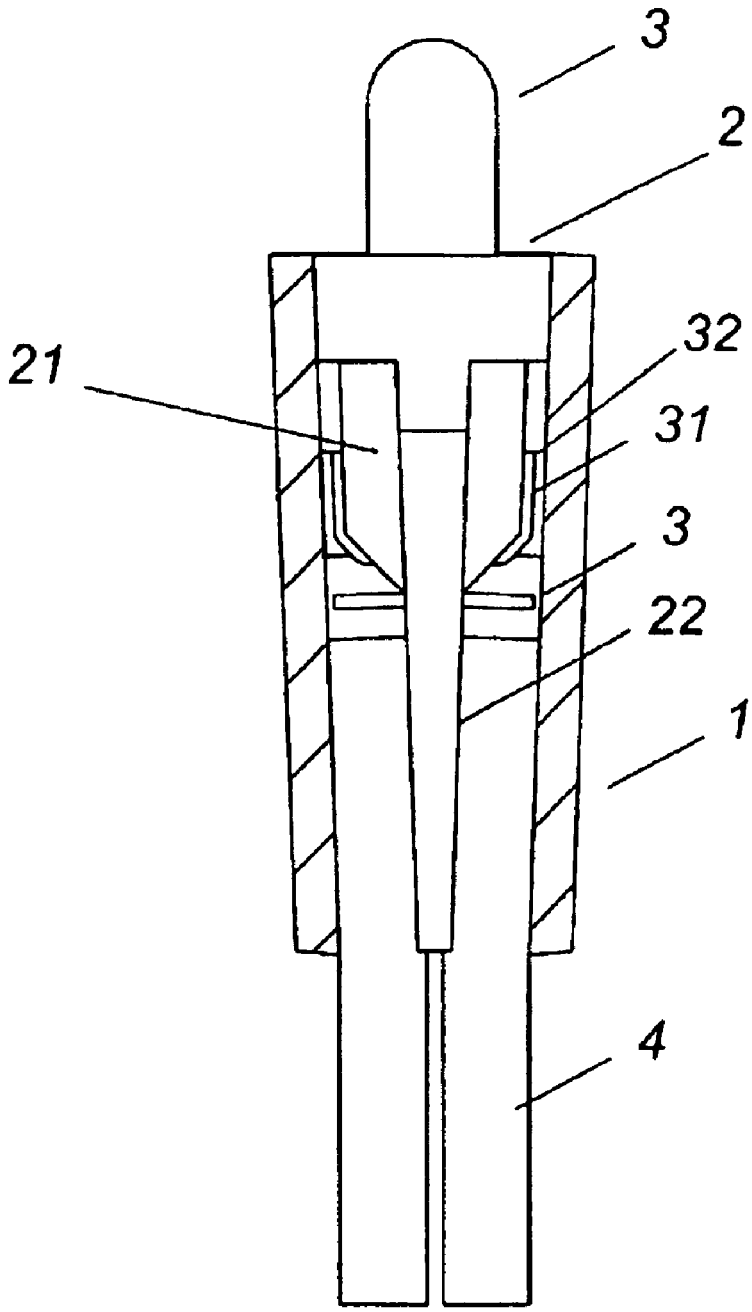
FIG. 3 is a sectional view of the present invention.
Figure 4:
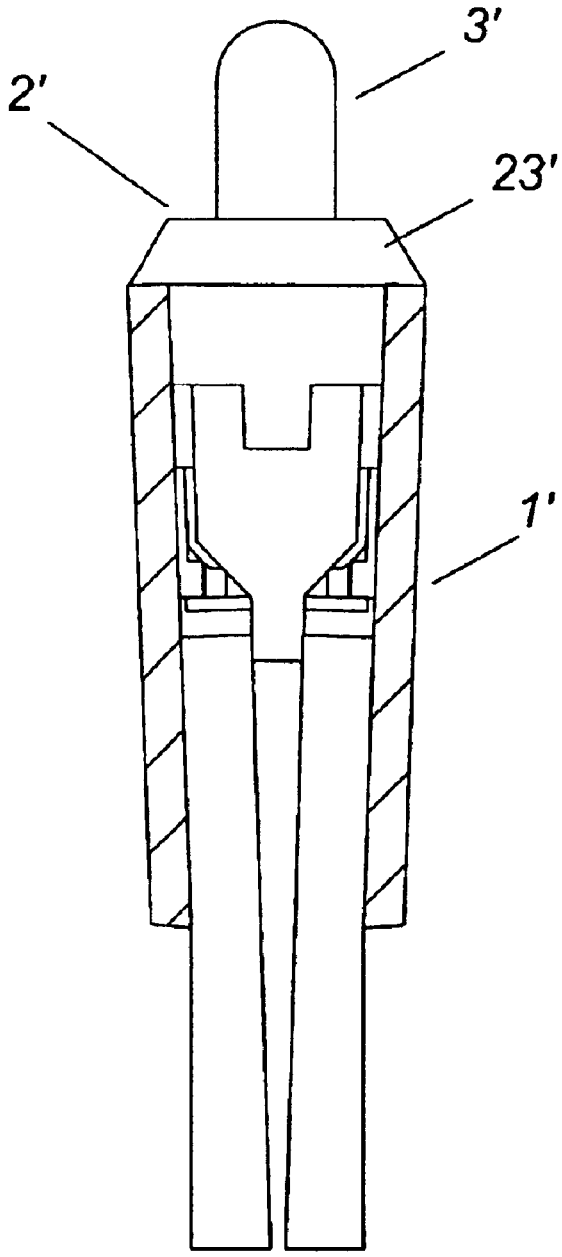
Prior Art Fig. 4
FIG. 4 is a side view of the prior art.

As shown in FIG. 2 and FIG. 3, the bulb 3 is located in the bar-base portion 23 of the bulb base 2; the conducting wires 31 of the bulb 3 penetrate the stopper 21 to the outside and are bent back against the outside wall separately working as a pair of conductive contacts. Coordinating to the both exposed wires 31, a pair of conducting strips 32 fixed on the tip ends of power cords 4 is pre-set at the coordinating positions in the lamp socket 33 of said lamp holder 1, so that, when the bulb base 2 is plugged into the lamp socket 31 of the lamp holder 1 in place, the bulb base 2 including the bar-base portion 23, the stopper 21 and the ejector pin 22 is submerged into the lamp socket 33 fully, simultaneously the conducting wire 31 of the bulb 3 contact with the conducting strips 32 tightly to lead to the power, and due to said size fit of the bulb base 2 and the lamp socket 33, the bar-base portion 23 will not project through the top rim of the lamp socket 33, meanwhile the ejector pin 22 extended from the bottom of the stopper 21 stretches into the opening of said lamp holder 1, so that the common person can not pick the bulb 3 off from the lamp holder 1 in the traditional way. But as wanting to replace the fail bulb 3, pushing up the ejector pin 22 from the bottom opening of the holder 1 with a tool takes off the bulb base 2 from the lamp holder 2.

I claim:

1. A decoration lamp holding frame comprised of a bulb base, a bulb and a lamp holder, wherein the lamp holder includes a lamp socket, wherein the bulb base is a molded whole piece sequentially including a bar-base portion, a stopper and an ejector pin, in which the diameter of the bar-base portion is a bit bigger than or equal the inside diameter of the lamp socket of the lamp holder, and a stopper formed next said bar-base portion extends downward toward the ejector pin, so that the sum height of the bar-base portion, the stopper and the ejector pin is bigger or equal the depth of the lamp socket of said lamp holder, and the segment of said lamp socket coordinating to the bar-base portion provides a housing depth that is bigger or equal the axial length of said bar-base portion.

* * * * *